US005627867A

United States Patent [19]

Thomson

[11] Patent Number: 5,627,867

[45] Date of Patent: May 6, 1997

[54] WATCHDOG CIRCUIT EMPLOYING MINIMUM AND MAXIMUM INTERVAL DETECTORS

[75] Inventor: David Thomson, Fremont, Calif.

[73] Assignee: Analog Devices, Inc., Norwood, Mass.

[21] Appl. No.: 610,156

[22] Filed: Feb. 29, 1996

[51] Int. Cl.[6] ..... G07C 3/02

[52] U.S. Cl. ..... 377/16

[58] Field of Search ..... 377/16

[56] References Cited

U.S. PATENT DOCUMENTS 5,228,066 7/1993 De Vane ..... 377/16

OTHER PUBLICATIONS

Steven R. Savitzky, "Basic Concepts and Components", *Real-Time Microprocessor Systems*, Van Nostrand Reinhold Company, New York, 1989, p. 80.

Paul Horowitz, Winfield Hill, "Microprocessors", *The Art of Electronics*, Second Edition, Cambridge University Press, New York, 1989, p. 764.

*Primary Examiner*—Margaret Rose Wambach

*Attorney, Agent, or Firm*—Koppel & Jacobs

[57] ABSTRACT

A watchdog circuit accepts an output signal from a monitored circuit such as a microprocessor to determine whether the monitored circuit is operating appropriately or has incurred an error. The monitored circuit must periodically assert the output signal to prevent the watchdog circuit, which imposes both upper and lower frequency bounds on the assertion of this signal, from "timing out" and setting a watchdog error alarm. The watchdog circuit may be combined with other circuits, such as power on reset, battery back-up switching, etc., within a microprocessor supervisory circuit.

20 Claims, 4 Drawing Sheets

WATCHDOG CIRCUIT EMPLOYING MINIMUM AND MAXIMUM INTERVAL DETECTORS

BACKGROUND OF THE INVENTION

1. Field of the Invention

The invention is related to microprocessor supervisory circuits and, in particular, to microprocessor "watchdog" circuits.

2. Description of the Related Art

Digital controllers such as microprocessors control instrumentation, computers, and automotive systems, to name just a few areas of application. Proper operation of the microprocessors in control of these applications is imperative. Improper operation could cause costly and, in some cases, life-threatening mistakes. If, for example, a system "glitch" causes a microprocessor to jump to an improper address, the microprocessor could interpret data as instructions and proceed to haphazardly overwrite critical life support data in an instrumentation application, to miscue an automatic braking system in an automotive application, or to destroy valuable stock-trading information in a computer application.

A microprocessor may be misdirected, as in the above examples, by a hardware failure initiated by radio frequency interference, by an electrostatic discharge, by mechanical failure such as a "cold" solder joint, or by a momentary power loss which corrupts the microprocessor's instructions. Software errors may also cause a microprocessor to "go south", getting stuck in an infinite loop (repeatedly executing the same instructions), for example. Because of the hazards associated with such microprocessor errors and the very real threat of their occurrence, supervisory circuits which include "watchdogs" have been developed and are widely employed within microprocessor-based circuits. Much as a referee might ask a boxer "how many fingers", a watchdog requires an associated microprocessor to occasionally assert a signal in order to assure the watchdog that the microprocessor has not entered an infinite loop, or is otherwise operating incoherently. Watchdogs are discussed in Stephen Savitsky, *Real-Time Microprocessor Systems*, Van Nostrand Reinhold, New York, 1989, page 80.

The block diagram of FIG. 1 illustrates a conventional watchdog 10. The watchdog 10 includes a counter 12 that is connected to count pulses from a clock 14. The counter 12 includes a reset input 16 which resets the counter to zero when asserted. The watchdog includes an input 18 connected to receive a signal, here labeled WDIN, from a microprocessor that is being monitored by the watchdog 10. During normal operation, i.e., after a system which employs the watchdog 10 has completed a power-up sequence and all inputs and outputs are generally assumed to be valid, the counter 12 begins to count output pulses from the clock 14. Should the counter reach a preset count, which corresponds with a prescribed maximum time interval, the counter asserts the watchdog output 20, labeled ALARM. The assertion of this signal by the watchdog may be employed by other circuitry, including the monitored microprocessor, to initiate a system reset (either hardware or software), for example. Therefore, in order to maintain its operational sequence, the microprocessor must regularly assert WDIN, thereby resetting the counter 12 preventing assertion of the ALARM signal. This provides some assurance that the microprocessor is not executing an infinite loop or is otherwise "distracted".

Watchdog circuits such as the one described in relation to FIG. 1 are sometimes combined with other circuits to form a supervisory circuit such as the supervisory circuit 22 of FIG. 2. As discussed in relation to FIG. 1, the watchdog circuit 10 monitors the input 18 and asserts the ALARM signal at output 20, which is connected to a reset generator 21, whenever the maximum prescribed interval between assertions of WDIN is exceeded. A comparator 24 compares a voltage V1 at its inverting input to a signal PWRFLI at its noninverting input and produces a power failure output signal PWRFLO. The signal PWRFLI represents the circuit's positive supply voltage and, whenever it falls below the level of V1, the comparator asserts the power failure output signal PWRFLO, indicating that the positive supply has fallen below a preset value. Another comparator 26 is connected at its inverting and noninverting inputs to positive supply voltage VCC and battery voltage VBATT, respectively. The comparator 26 controls a switch 28 which connects either VBATT or VCC to a power output VOUT. Whenever VBATT is greater than VCC, VBATT is connected, through the switch 28, to VOUT. Conversely, whenever VCC is greater than VBATT, VCC is connected through the switch 28 to VOUT.

Additionally, a comparator 30 is connected to a voltage reference V2 and to the positive supply voltage VCC at its inverting and noninverting inputs, respectively. Whenever the positive supply voltage drops below the level of V2, the comparator 30 sends a negative signal to the reset generator 21. In this case, the reset generator 21 may activate the signal RESET available at an output 32, to reset the system because, even though VOUT has been switched to VBATT, there may have been some disruption to the circuit when VCC fell below V2. The reset generator 21 may also include power-on-reset circuitry to ensure that circuitry which relies upon the RESET signal is not permitted to commence operation until after the positive power supply voltage VCC has reached a prescribed safe operating level.

Although the watchdog 20 ensures that an associated microprocessor is sufficiently operational to assert the WDIN signal periodically, there are failure mechanisms that would allow the microprocessor to assert WDIN signal with sufficient frequency to satisfy the watchdog requirement, even though the microprocessor is "lost". For example, the microprocessor may, through random operation or by virtue of being stuck in a loop, continuously assert WDIN every instruction cycle.

SUMMARY OF THE INVENTION

The invention is directed to a watchdog circuit that reduces the likelihood that a monitored circuit such as a microprocessor could, in spite of errant operation, fail to trigger the watchdog circuit. The new watchdog circuit includes a minimum interval detector in addition to a maximum interval detector. The interval detectors, in combination, impose both upper and lower bounds upon the frequency with which a microprocessor must assert a watchdog signal to prevent a watchdog alarm. The minimum and maximum interval detectors may be combined in a variety of ways. The watchdog input signal could be routed to both detectors in parallel, with their outputs combined to create a watchdog alarm or the input signal could be routed first to the maximum interval detector, then to the minimum interval detector to create the watchdog alarm. In the preferred embodiment, the watchdog input signal is routed in sequence to the minimum interval detector and, from there, to the maximum interval detector.

The new watchdog circuit requires a monitored circuit, e.g., a microprocessor, to periodically assert a watchdog input signal to prevent the watchdog from activating an alarm. An assertion of the watchdog input signal is routed to a minimum interval detector where it initiates a minimum interval counter. If, at the end of the minimum interval, no further assertions of the watchdog input signal have taken place, the transition is passed to the maximum interval detector. On the other hand, every subsequent assertion of the watchdog input prior to the end of the minimum interval resets the counter and prevents passage of any assertion on to the maximum interval detector. The maximum interval detector independently measures a maximum interval and, when that interval is reached, activates the watchdog alarm signal. However, if an assertion is passed from the minimum interval detector to the maximum interval detector, the maximum interval detector is reset, thus preventing assertion of the alarm output. Thus, if the watchdog input is asserted either too frequently or not frequently enough, the watchdog circuit asserts the alarm signal.

In a preferred embodiment, the watchdog circuit is combined with voltage regulators and a reset circuit to form a supervisory circuit. Additionally, a single clock provides pulses to both the minimum and maximum interval detectors. This reduces the amount of trimming required because only one clock need be trimmed, rather than two. These and other features, aspects and advantages of the invention will be apparent to those skilled in the art from the following detailed description, taken together with the accompanying drawings.

DETAILED DESCRIPTION OF THE INVENTION

Figure 1:
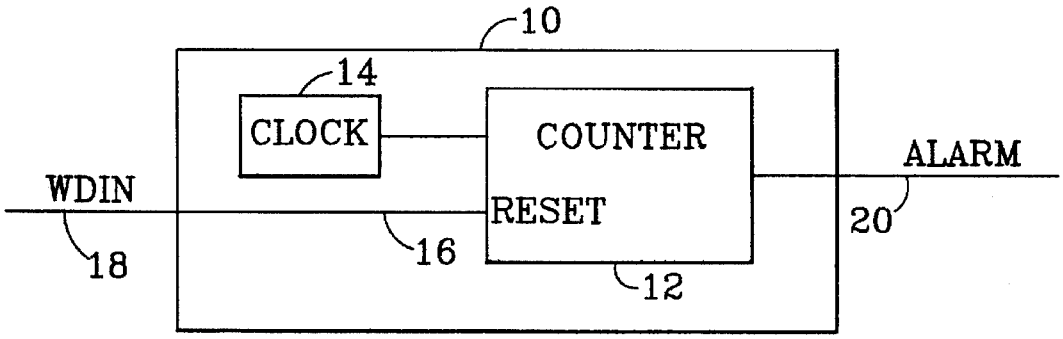
FIG. 1 (Prior Art)
FIG. 1 is a block diagram which illustrates the basic components of a conventional watchdog circuit.
Figure 2:
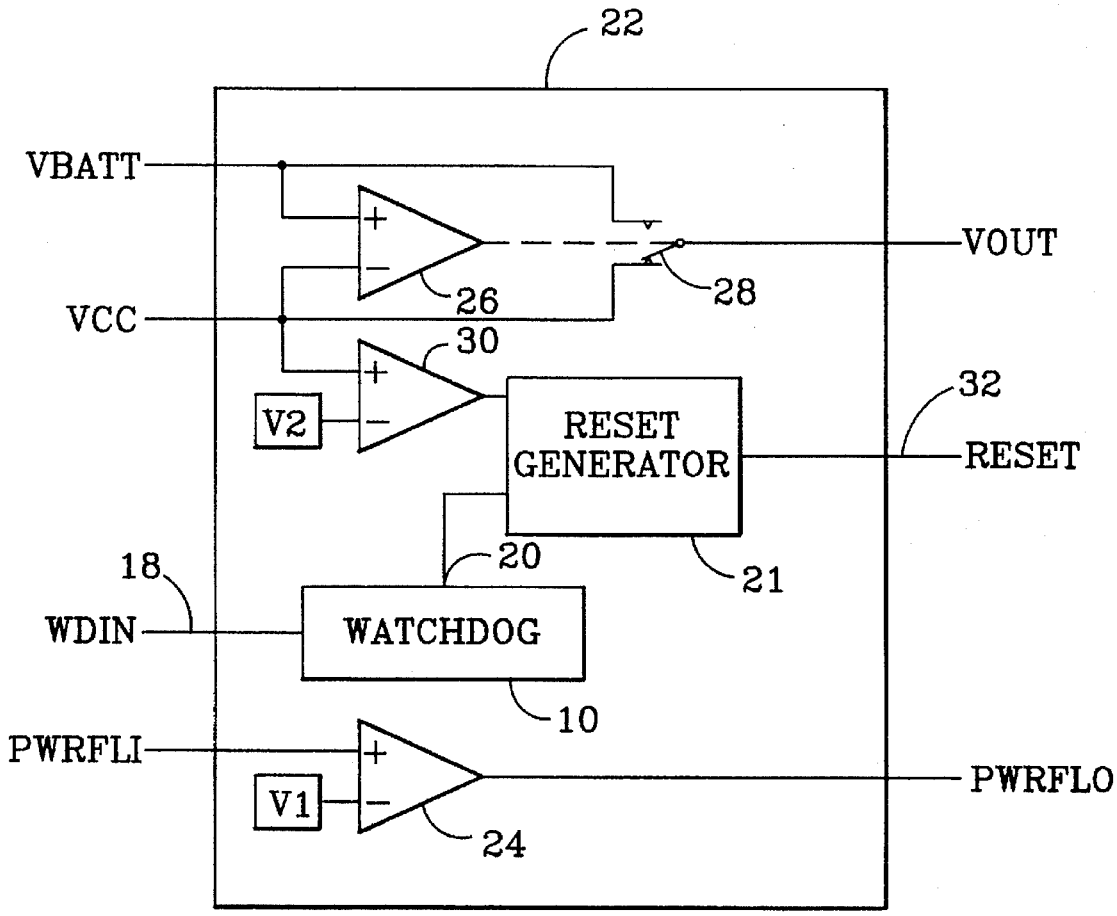
FIG. 2 (Prior Art)
FIG. 2 is a block diagram illustrating a conventional supervisory circuit which incorporates a watchdog circuit, power failure sensing, and power switching into one device.
Figure 3A:
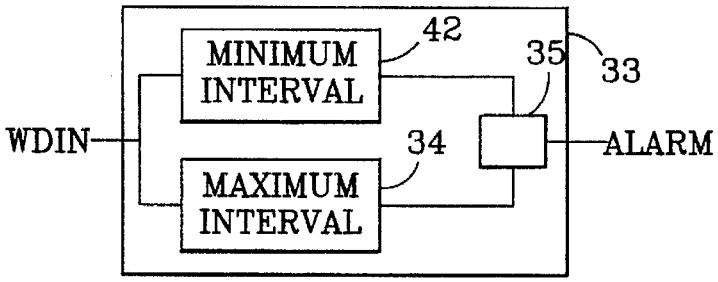
FIG. 3A is a block diagram of a parallel implementation of the novel watchdog circuit.
Figure 3B:
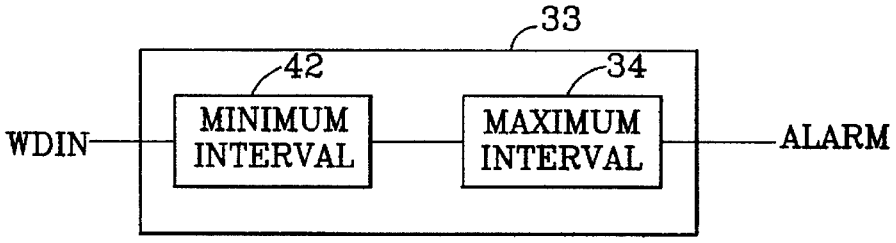
FIG. 3B is a block diagram which illustrates a series implementation of the new watchdog circuit.
Figure 3C:
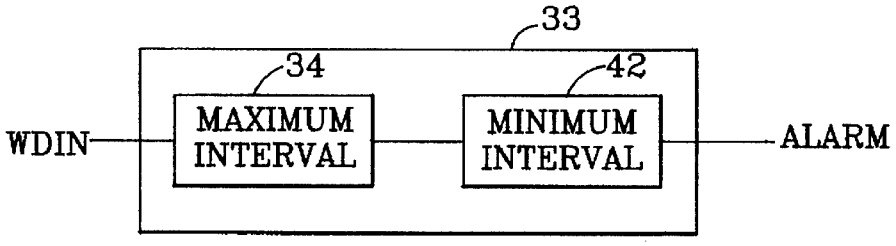
FIG. 3C illustrates an alternative series implementation of the new watchdog circuit.

The new watchdog circuit 33 illustrated in the block diagrams of FIGS. 3A–3B includes a maximum interval detector 34 and a minimum interval detector 42. In the implementation of FIG. 3A, the minimum interval detector 42 and maximum interval detector 34 receive a watchdog input signal WDIN in parallel. The respective outputs of the minimum interval detector 42 and maximum interval detector 34 are combined in a combiner 35 to create an alarm output signal ALARM. The alarm signal ALARM is activated whenever assertions of WDIN are out-of-range, i.e., whenever they occur too frequently or too infrequently. In the embodiment of FIG. 3B, the signal WDIN is routed in sequence to the minimum interval detector 42, then to the maximum interval detector 34 to create the alarm signal ALARM. Again, whenever assertions of WDIN are out-of-range, the watchdog circuit 33 asserts the signal ALARM. The embodiment of FIG. 3C routes the WDIN signal to the maximum interval detector 34 then to the minimum interval detector 34 which asserts the signal ALARM whenever assertions of WDIN are out-of-range.

Figure 4:
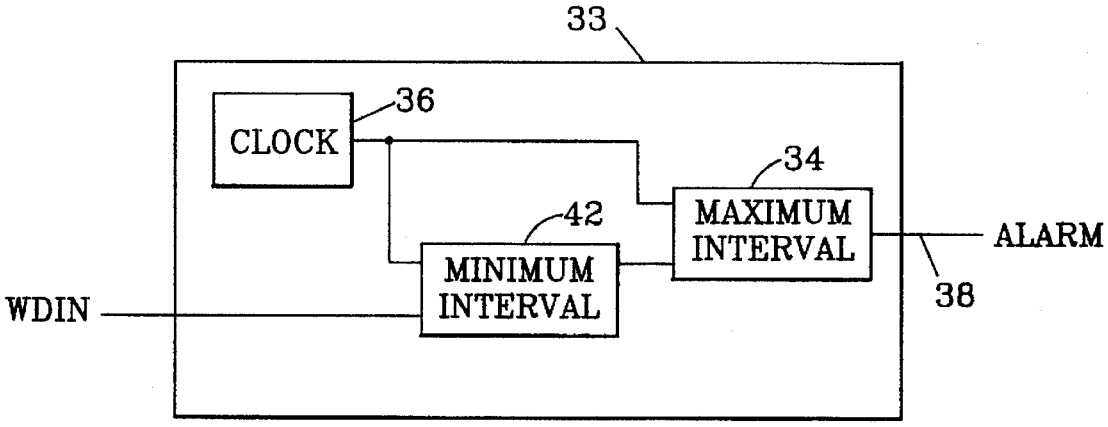
FIG. 4 illustrates the interconnection of the major components of the new watchdog circuit.

The new watchdog circuit 33 illustrated in the block diagram of FIG. 4 includes a maximum interval detector 34 which is connected to receive pulses from a clock 36. After being reset, the detector 34 counts clock pulses and, if it reaches a predetermined maximum count corresponding to a maximum prescribed interval, it activates a signal ALARM which is available at the watchdog output 38. To prevent the watchdog from activating ALARM, a monitored circuit must reset the maximum interval detector before it reaches the maximum count. To this end, an input 40 is provided to receive a watchdog input signal WDIN. The input 40 is connected to a minimum interval detector 42 which also receives clock pulses from the clock 36.

The minimum interval detector 42 operates to limit the frequency with which a monitored circuit may validly assert the WDIN signal. In effect, once the minimum interval detector determines that WDIN has been asserted, it "holds" this assertion for a predetermined period of time. If, during this period of time there are no further assertions of WDIN, the minimum interval detector allows the next assertion of WDIN to pass to the maximum interval detector, thereby resetting the maximum interval detector and blocking assertion of ALARM. Only those assertions of WDIN which are spaced at least the minimum interval apart from the immediately preceding assertion are passed on to reset the maximum interval detector. By imposing both minimum and maximum interval requirements on the assertion of the watchdog input signal WDIN, the circuit substantially reduces the likelihood that a "berserk", i.e., improperly operating, microprocessor could continue to operate. For example, a microprocessor could be stuck in a loop in which it asserts the watchdog input every fourth clock cycle. If the minimum interval is ten clock cycles, the microprocessor's "mindless" assertion of WDIN will not be mistaken for a valid assertion of the signal and the watchdog output signal ALARM will be asserted. Additionally, random assertions of the watchdog input signal WDIN which occur frequently enough to satisfy the maximum interval requirement may occur too frequently to satisfy the minimum interval requirement, and therefore will not be passed on to the maximum interval detector. In this preferred embodiment, the minimum interval detector 42 does not activate ALARM every time assertions of WDIN violate the minimum interval requirement, rather, in those cases, it blocks passage of WDIN assertions to the maximum interval detector 34.

In a preferred implementation, the watchdog circuit 33 is combined with other circuitry in a single integrated circuit. In such an implementation it is advantageous to employ a single clock, such as the clock 36, to supply both the minimum and maximum interval detectors 42 and 34, respectively. This reduces the clock adjustment process to a single laser-trimming step. The maximum and minimum intervals may be adjusted, for example, by adjusting the clock frequency. The maximum interval should be set so as to minimize the damage caused by a runaway microprocessor, and the minimum interval should be set with the microprocessor's operating speed in mind. If, for example, the monitored microprocessor requires four instructions of two clock cycles apiece to assert the WDIN signal, the minimum interval should be at least 2*4*2 clock cycles long in order to be effective. The microprocessor clock cycles may or may not equal the clock cycles of the watchdog clock 36; the minimum and maximum intervals used to test WDIN are adjusted to compensate for any differences between the microprocessor and watchdog clocks. Although the illustrated preferred embodiment of the watchdog circuit includes a clock, an external clock may be employed in the alternative.

Figure 5:
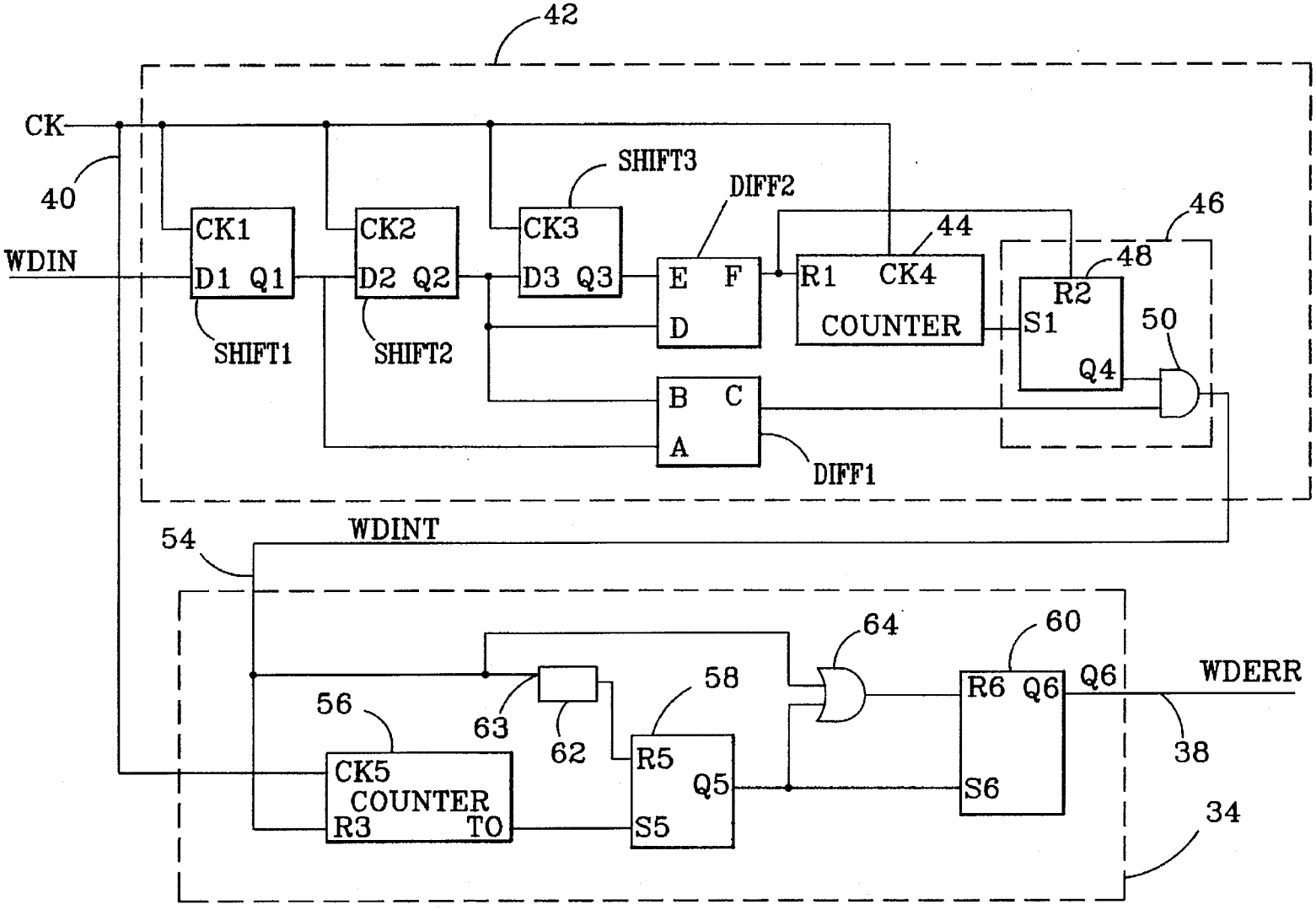
FIG. 5 is a more detailed functional diagram of the new watchdog circuit of FIG. 3.

The block diagram of FIG. 5 provides more details of the minimum interval detector 42 and the maximum interval detector 34. Beginning with an analysis of the minimum interval detector, three shifters SHIFT1, SHIFT2 and SHIFT3 that shift the WDIN signal into the circuit are connected at their clock inputs CK1, CK2 and CK3, respectively, to a clock signal CK. A counter 44 also has its clock input CK4 connected to receive and to count pulses in the clock signal CK. The shifters SHIFT1, SHIFT2 and SHIFT3 also feature data inputs D1, D2 and D3, and data outputs Q1, Q2 and Q3, respectively. The data input D1 is connected to receive the watchdog input signal WDIN at an input 40. The output Q1 is connected to the input D2 and the output Q2 is connected to the input D3. In a preferred embodiment the shifters SHIFT1, SHIFT2, and SHIFT3 are implemented as D type flip-flops. The watchdog input WDIN is successively shifted through the shifters SHIFT1, SHIFT2 and SHIFT3 by the respective clock inputs CK1, CK2 and CK3 so that a transition in the signal WDIN appearing at the watchdog input 40 will appear at the output Q1 after one clock cycle, at the output Q2 after two clock cycles, and at the output Q3 after three clock cycles.

Difference detectors DIFF1 and DIFF2 are connected to detect differences between outputs Q1 and Q2 and between outputs Q2 and Q3, respectively. In a preferred embodiment, the difference detectors DIFF1 and DIFF2 are implemented as EXCLUSIVE NOR gates. As a state change in the watchdog input signal WDIN is shifted through the shifters SHIFT1—SHIFT3, the difference detectors DIFF1 and DIFF2 will detect this change in state sequentially, i.e., DIFF1 will detect the transition at its inputs A and B and modify its output C to reflect the change, and subsequently DIFF2 will detect the transition at its inputs D and E and modify its output F accordingly. The output F of difference detector DIFF2 is connected to the reset input R1 of a counter 44. Whenever the difference detector DIFF2 detects a transition in the WDIN signal, i.e., whenever the signals at its E and D inputs differ, it resets the counter 44 and a set/reset/and (SRAND) gating block 46.

In the preferred embodiment, the SRAND gating block 46 includes a set/reset (SR) latch 48 and an AND gate 50. The SR latch has inputs S1 and R2 and an output Q4 which is connected to one input of an AND gate 50. The AND gate 50 acts to gate the output from the difference detector DIFF1. When the counter "times out", i.e., reaches its prescribed count, it sets the latch 48, thus placing a logic "1" at the active high output Q4 and allowing the transfer of a logic "1" through the AND gate 50. Conversely, until the detector times out, the SR latch 48 remains reset, providing a logic "0" at the AND gate and thereby "blocking" the transfer of a logic "1".

To aid in the understanding of the sequential operation of the minimum interval detector 42, first assume that the counter 44 has "timed out" and that the latch output Q4 is "1" (in order for these conditions to exist, their must have been a valid assertion of the watchdog input WDIN). As a WDIN assertion shifts through shifters SHIFT1–SHIFT3, difference detector DIFF1 will detect a difference between its inputs A and B and place a logic "1" at its output C. Since the other input to the AND gate 50 is also at a logic "1" (the timed-out counter set the latch 48), the output of the AND gate 50 is also a logic "1". As will be discussed in greater detail below, a logic "1" at this point resets the maximum interval detector, thereby preventing a watchdog alarm activation.

Assuming now, contrary to the above example, that after the first valid assertion of WDIN the signal WDIN is asserted again before the counter 44 times out. In this case, as the assertion is shifted through the shifters SHIFT1–SHIFT3, the difference detector DIFF1 will detect the transition and change the state of its signal at the output C to a logic "1" However, since the counter 44 will not have timed out, the latch 48 will remain reset(latch 48 is reset by DIFF2 at the same time it resets the counter 44) and block the transfer of logic "1". In this way, only assertions of the WDIN signal which are spaced at least the minimum interval apart are allowed to reset the maximum interval detector.

A valid (properly timed) WDIN assertion will pass through the minimum interval detector 42 in the manner just described and proceed to the maximum interval detector 34 from the output of the SRAND gating block 46 to the input 54 of the maximum interval detector, where the intermediate watchdog signal is given the label WDINT. The maximum interval detector 34 includes a counter 56 that is connected at its reset input R3 to the input 54, and at its clock input CK5 to receive the clock signal CK. The "timeout" output TO of the counter 56 is connected to the set input S5 of a set/reset (SR) latch 58. The output Q5 of the SR latch 58 is connected to the set input S6 of an SR latch 60, whose output Q6 provides the watchdog error signal WDERR at the output 38 of the watchdog circuit 33. Additionally, a pulse generator 62 is connected at its input 63 to the input 54 and generates a pulse in response to the assertion of WDINT. This pulse is passed along to the reset input R5 of the SR latch 58. An OR gate 64 is connected to logically OR the signal appearing at the input 54 with that at the output Q5 of the latch 58. The output of the OR gate 64 is connected to the reset input R6 of the SR latch 60.

In analyzing the maximum interval detector, first assume that the counter 56 has not "timed-out" and is counting toward its maximum prescribed count. An assertion of WDINT resets the counter 56 and, so long as the counter is continuously reset in this fashion, the counter 56 never times out and the watchdog error signal WDERR is never asserted. If, however, WDINT is not asserted before the counter 56 times out, the counter output TO sets the latch 58 which, in turn, sets the latch 60, thereby activating the watchdog error signal WDERR. Assuming now that WDERR has been activated as just described, the counter time out output TO is active, and latches 58 and 60 are set. Until WDINT is asserted, the counter output TO and latch outputs Q5 and Q6 will remain set. When WDINT is asserted, the counter 56 will be reset. While the output TO could be employed as the watchdog output, in the preferred embodiment the additional circuitry, including the pulse generator 62, OR gate 64 and SR latches 58 and 60, is employed to impose further restrictions upon a monitored circuit such as a microprocessor, thus further ensuring more coherent operation of the monitored circuit.

The contribution of this "additional circuitry" is as follows. As noted above, assertion of WDINT resets the counter 56, thus releasing the set input S5 of SR latch 58. Additionally, assertion of WDINT causes the pulse generator 62 to generate a pulse which arrives at the reset input R5 after the counter 56 has released the set input S5 and, therefore, resets the SR latch 58. Since the SR latch 58 is reset, the set input S6 of SR latch 60 is also released, enabling a negative input at the reset input R6 to reset the latch 60, thus de-asserting the watchdog error output WDERR. Turning now to the OR gate 64 which provides the input signal to R6, although the output Q5 is low after the pulse generator 62 resets the SR latch 58, the other input to the OR gate 64 is high by the time Q5 switches to a logic low, because the negative pulse which constitutes the assertion of WDINT is not delayed, as the pulse from the pulse generator 62 is.

However, a subsequent valid assertion of WDINT before the counter times out will reset the latch 60, thereby deasserting WDERR because the output Q5 will already be low, allowing the negative pulse of WDINT at the other input to the OR gate 64 to pass through and reset the SR latch 60. By delaying the de-assertion of the WDERR signal in this fashion, the WDIN signal must be validly asserted at least twice within the maximum prescribed period before the WDERR signal is released, thus providing further assurance that a monitored circuit is operating coherently before it is allowed to proceed with other tasks.

Figure 6:
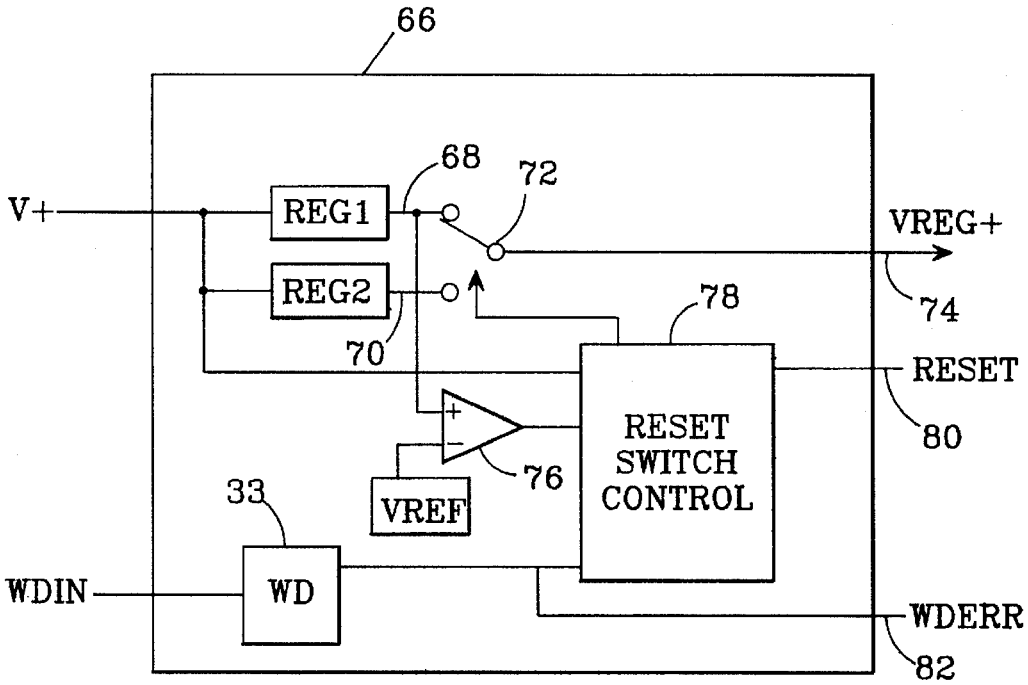
FIG. 6 illustrates a new supervisory circuit which includes the watchdog circuit of FIG. 3

The new watchdog circuit 33 of FIG. 4 may be employed by a supervisory circuit 66 as illustrated in the block diagram of FIG. 6. The supervisory circuit 66 includes two voltage regulators REG1 and REG2 which are connected to receive an unregulated positive input voltage V+ and to provide regulated output voltages at their respective outputs 68 and 70. One or the other of outputs 68 and 70 are connected through a switch 72 to a regulated output voltage terminal 74 which provides a regulated output voltage VREG+ for use by other circuitry, such as a microprocessor (not shown), monitored by the supervisory circuit 66. A comparator 76 is connected at its inverting and noninverting inputs to a voltage reference VREF and the regulated voltage output 68, respectively. The output of the comparator 76 is fed to a reset/switch controller 78 which also accepts the watchdog error signal WDERR from the watchdog circuit 33.

Based upon the values of the watchdog alarm signal WDERR and that from the comparator 76, the reset/switch controller 78 provides an output signal RESET, available at the supervisory circuit output 80. Additionally, the reset/switch controller controls the switch 72, connecting the output 68 through the switch 72 to the VREG+ output 72 so long as the output voltage from the regulator REG1 is at least equal to the reference voltage VREF. Whenever the output from the regulator REG1 falls below VREF, the controller 78 connects the output 70 of the regulator REG2 through the switch 72 to the output 74. In this manner, the supervisory circuit provides a backup regulated voltage supply from the regulator REG2 to the output 74 whenever the regulator REG1 fails. The controller 78 also asserts the RESET output whenever the switch 72 is switched from one connection to another and includes power on reset circuitry which asserts the RESET, based upon the positive supply voltage V+, while power is being applied to the circuit 66. Power on reset circuits are known in the art and are discussed in Paul Horowitz, Winfield Hill, *The Art of Electronics*, Cambridge University Press, New York, 1989, page 764. The watchdog alarm signal WDERR is also available at the output 82 for use by other circuitry which may use it, for example, to disregard signals from the supervised circuit at any time the WDERR signal is asserted.

Figure 7:
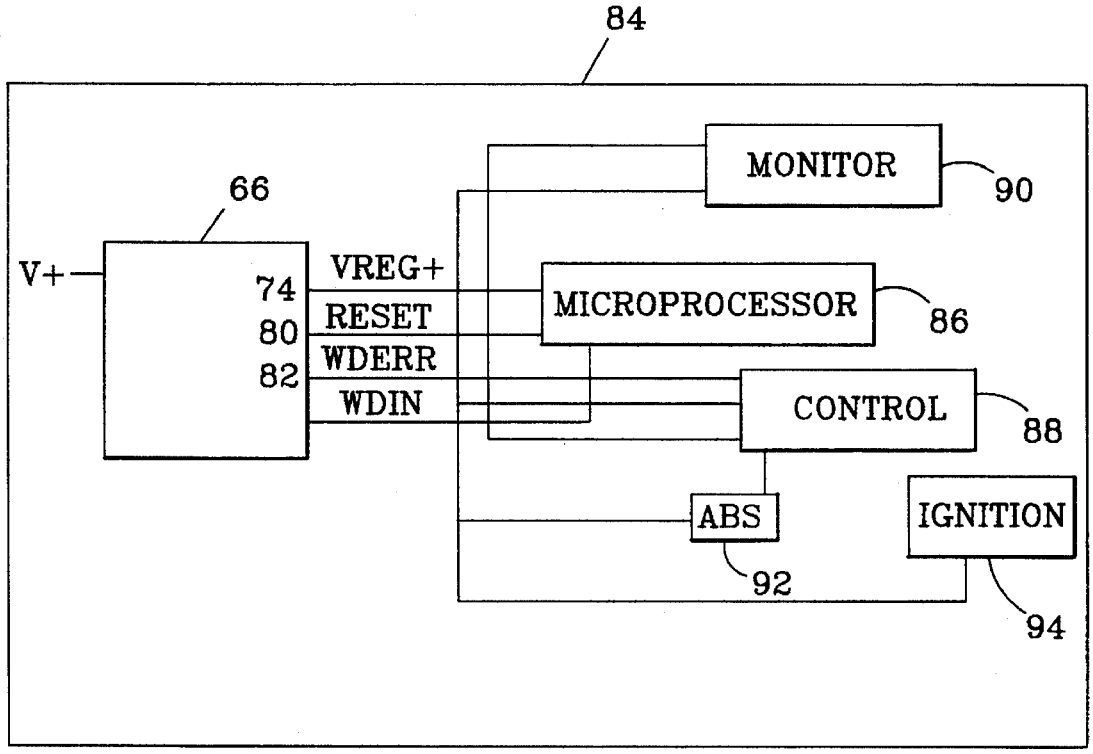
FIG. 7 is a block diagram of an automotive microprocessor-based control system which employs the new watchdog circuit as a part of a supervisory circuit.

The new supervisory circuit 66 of FIG. 6 may be employed within a microprocessor-based automotive control system 84 illustrated in the block diagram of FIG. 7. As described in the discussion of FIG. 6, the supervisory circuit 66 accepts an unregulated input voltage V+ and provides a regulated output voltage VREG+. Additionally, the supervisory circuit 66 accepts a watchdog input WDIN from a microprocessor 86 and provides a watchdog alarm output WDERR which, in this implementation, is connected to a control circuit 88. The microprocessor employs a monitor circuit 90 and control circuit 88 as intermediaries to monitor automotive functions, such as brake slippage, combustion efficiency, etc., and to control an anti-lock braking system 92 and an ignition system 94. All the components 86–94 are supplied with regulated power from the supervisory circuit through output 74. The microprocessor 86, control 88, and monitor 90 circuits additionally are connected to the reset output 80 for reset control. The watchdog alarm output 82 is connected to the controller 88, which is forced into a default state whenever the watchdog error alarm WDERR is asserted. This default state prevents errors from the microprocessor from propagating to the ABS 92 and IGNITION 94 systems.

The forgoing description of specific embodiments of the invention has been presented for the purposes of illustration and description. It is not intended to be exhaustive or to limit the invention to the precise forms disclosed, and many modifications and variations are possible in light of the above teachings. For example, use of the term microprocessor is not to be construed as any one type of microprocessor such as complex instruction set, reduced instruction set, von Neumann architecture, Harvard architecture, etc. Furthermore, the term, in its use here, is meant to encompass microcontrollers, microcomputers, bit-slice controllers, and special-purpose controllers such as digital signal processors etc. The watchdog's minimum and maximum intervals may be adjusted when they are produced or subsequently by an original equipment manufacturer, for example. The clock may be internal to the watchdog circuit, or it may be provided by external circuitry. The combinatorial logic used in the preferred embodiment may be implemented in one of numerous interchangeable ways through use of logic transformation techniques such as Karnaugh maps, De-Morgan's laws, etc. The outputs and inputs of various components could be active low or active high with appropriate modifications of connected circuits.

The embodiments were chosen and described in order to best explain the principles of the invention and its practical application, to thereby enable others skilled in the art to best utilize the invention. It is intended that the scope of the invention be limited only by the claims appended hereto.

I claim:

1. A watchdog circuit, comprising:

a minimum interval detector connected to receive a watchdog input signal from a monitored circuit and to determine whether intervals between assertions of the input signal are at least a minimum specified interval and to provide an indication of whether the intervals are the specified minimum, a maximum interval detector connected to receive a watchdog input signal from a monitored circuit and to determine whether intervals between asssertions of the input signal are less than a maximum specified interval and to provide an indication of whether the intervals are the specified maximum, and combining circuitry connected to said minimum and maximum interval detectors to combine said indications to produce watchdog alarm output signal.

2. The watchdog circuit of claim 1, wherein said combining circuitry asserts said alarm signal whenever the interval between assertions of the watchdog input signal is less than a prescribed minimum interval or the interval between assertions of the watchdog input is greater than a prescribed maximum interval.

3. The watchdog circuit of claim 1, wherein said combining circuitry asserts said alarm signal whenever the interval between assertions of the watchdog input signal is less than a prescribed minimum interval and the interval between assertions of the watchdog input is greater than a prescribed maximum interval.

4. The watchdog circuit of claim 1, wherein said combining circuitry includes sequential circuitry.

5. The watchdog circuit of claim 4, wherein said sequential circuit imposes the requirement that the minimum interval detector requirements be satisfied before the maximum interval detector requirements.

6. The watchdog circuit of claim 4, wherein said sequential circuit imposes the requirement that the maximum interval detector requirements be satisfied before the minimum interval detector requirements.

7. A watchdog circuit, comprising:

a minimum interval detector connected to receive a watchdog input signal from a monitored circuit, a maximum interval detector connected to receive a watchdog input signal from a monitored circuit, and an alarm output, said minimum interval detector and maximum interval detector connected to assert said alarm output whenever the interval between assertions of the watchdog input signal is less than a prescribed minimum interval and the interval between assertions of the watchdog input is greater than a prescribed maximum interval.

8. A watchdog circuit, comprising:

a minimum interval detector connected to receive a watchdog input signal from a monitored circuit and to block assertions of that signal whenever the interval between assertions of that signal is less than a prescribed minimum interval, and to pass those assertions whenever the interval between assertions of that signal is greater than or equal to the prescribed minimum interval, and a maximum interval detector which includes an alarm output, connected to receive assertions of said watchdog input signal from said minimum interval detector, said maximum interval detector connected to assert said alarm output whenever the interval between assertions of the signal from the minimum interval detector exceeds a prescribed maximum interval.

9. The watchdog circuit of claim 8, further comprising a clock circuit connected to provide a pulsed clock signal to said minimum and maximum interval detectors.

10. The watchdog circuit of claim 8, wherein said minimum interval detector is connected to count clock pulses and to pass only those assertions of said watchdog input signal which are spaced at least a predetermined number of clock pulses apart.

11. The watchdog circuit of claim 9, wherein said minimum interval detector comprises:

a counter connected to count pulses from said clock, first, second and third shifters connected to shift said watchdog input signal, two difference detectors, one connected to detect differences between the outputs of said first and second shifters, the other connected to detect differences between the outputs of said second and third shifters, with one of said difference detectors connected to reset said counter when a difference between shifter outputs is detected.

12. The watchdog circuit of claim 11, wherein said minimum interval detector further comprises a gating block having set and reset inputs, an AND input and an output, said set input connected to be asserted by said counter upon said counter's timing out, said reset input connected to the difference detector output which is connected to reset said counter, said AND input connected to the output of the other difference detector, and said gating block output connected to provide an intermediate watchdog signal.

13. The watchdog circuit of claim 11, wherein said maximum interval detector comprises a counter connected to count said clock pulses and to be reset by said intermediate watchdog signal.

14. A supervisory circuit, comprising:

a watchdog circuit including a minimum interval detector having an input, said input connected to receive a watchdog input signal from a monitored circuit and to block assertions of that signal whenever the interval between assertions of that signal is less than a prescribed minimum interval and to pass those assertions whenever the interval between assertions of that signal is greater than or equal to the prescribed minimum interval, a maximum interval detector which includes an alarm output, connected to receive said signal from said minimum interval detector, said maximum interval detector connected to assert said alarm output whenever the interval between assertions of the signal from the minimum interval detector exceeds a prescribed maximum interval, a clock circuit connected to provide clock pulses to said minimum and maximum interval detectors, and a reset/switch controller circuit connected to receive said watchdog output signal and to provide a reset output signal.

15. The supervisory circuit of claim 14 further comprising:

voltage regulators connected to receive an unregulated input voltage and to provide regulated voltages at respective regulator outputs, a switch controller, a regulated voltage output and a switch connected, under control of said switch controller between one of said regulator outputs and said regulated voltage output.

16. The supervisory circuit of claim 15, further comprising a voltage reference and comparator having two inputs and an output, with one input of said comparator connected to the output of one of said regulators, the other input connected to the voltage reference, and the output of said comparator connected to said switch controller.

17. A microprocessor based system, comprising:

a microprocessor, a supervisory circuit connected to receive a watchdog input signal from said microprocessor and to provide a watchdog alarm signal output, said supervisory circuit comprising a watchdog circuit including a minimum interval detector having an input, said input connected to receive a watchdog input signal from a monitored circuit and to block assertions of that signal whenever the interval between assertions of that signal is less than a prescribed minimum interval and to pass those assertions whenever the interval between assertions of that signal is greater than or equal to the prescribed minimum interval, and a maximum interval detector which includes an alarm output, connected to receive said signal from said minimum interval detector, said maximum interval detector connected to assert said alarm output whenever the interval between assertions of the signal from the minimum interval detector exceeds a prescribed maximum interval.

18. The system of claim 17, further comprising:

a clock circuit connected to provide clock pulses to said minimum and maximum interval detectors, and a reset/switch controller circuit connected to receive said watchdog output signal and to provide a reset output signal.

19. A method for producing a watchdog alarm signal, comprising the steps of:

testing a watchdog input signal to determine whether assertions of it meet a minimum interval requirement, testing a watchdog input signal to determine whether assertions of it meet a maximum interval requirement, activating an alarm if the watchdog input interval violates either interval requirement.

20. A method for producing a watchdog alarm signal, comprising the steps of:

testing a watchdog input signal to determine whether it meets a minimum interval requirement, passing only those assertions of the watchdog input signal to a maximum interval detector which meet the minimum interval requirement, activating an alarm if the assertions passed by the minimum interval detector fail to meet a maximum interval requirement.

* * * * *